US010639928B1

(12) United States Patent
Johnson

(10) Patent No.: US 10,639,928 B1
(45) Date of Patent: May 5, 2020

(54) PITCHER'S CIRCLE COMPASS

(71) Applicant: Edgar R Johnson, North Wales, PA (US)

(72) Inventor: Edgar R Johnson, North Wales, PA (US)

( * ) Notice: Subject to any disclaimer, the term of this patent is extended or adjusted under 35 U.S.C. 154(b) by 227 days.

(21) Appl. No.: 15/986,944

(22) Filed: May 23, 2018

(51) Int. Cl.
*B43L 9/04* (2006.01)

(52) U.S. Cl.
CPC ..... *B43L 9/045* (2013.01)

(58) Field of Classification Search
CPC ..... B43L 9/04; B43L 9/045
USPC ..... 33/27.03, 27.031, 27.032, 27.033
See application file for complete search history.

(56) References Cited

U.S. PATENT DOCUMENTS

| | | | | | |
|---|---|---|---|---|---|
| 962,702 | A | | 6/1910 | Diracca | |
| 1,572,237 | A | | 2/1926 | Hunt | |
| 2,602,233 | A | | 7/1952 | Irving | |
| 2,627,662 | A | * | 2/1953 | Taylor | B43L 9/04 33/27.031 |
| 2,737,720 | A | * | 3/1956 | Kaser | B26F 1/3846 408/85 |
| 2,781,584 | A | | 2/1957 | Cedarholm | |
| 3,039,197 | A | | 6/1962 | Abbott | |
| 3,668,781 | A | | 6/1972 | Teter | |
| 3,678,592 | A | | 7/1972 | Williamson | |
| 3,834,030 | A | | 9/1974 | Hanson | |
| 3,948,521 | A | | 4/1976 | Warren | |
| 4,160,324 | A | | 7/1979 | Dunn | |
| 4,162,789 | A | | 7/1979 | Hollaway | |
| 4,267,637 | A | * | 5/1981 | Paull | G01C 15/12 33/1 G |
| 4,916,820 | A | * | 4/1990 | Kozyrski | B26F 1/3846 225/96 |
| 5,235,754 | A | * | 8/1993 | Sirois | B43L 9/04 33/27.01 |
| 5,253,421 | A | | 10/1993 | Landmark | |
| 5,371,949 | A | | 12/1994 | Delaurer | |
| 5,427,383 | A | | 6/1995 | Viens | |
| 5,465,962 | A | | 11/1995 | Hiserman | |
| 5,556,090 | A | | 9/1996 | Coleman | |
| 5,735,052 | A | * | 4/1998 | Lin | B43L 9/045 33/27.03 |
| 6,012,228 | A | | 6/2000 | Fisanich | |
| 6,141,880 | A | * | 11/2000 | Vircks | A63C 19/06 33/1 G |
| 6,430,819 | B1 | | 8/2002 | Aldstadt | |
| 6,843,739 | B2 | | 1/2005 | Putnam | |
| 6,851,199 | B1 | | 2/2005 | Zeitz | |
| 6,893,365 | B2 | * | 5/2005 | Rathbun | A63B 69/0002 33/1 G |
| 6,907,669 | B1 | * | 6/2005 | Han | B43K 29/001 33/27.03 |

(Continued)

*Primary Examiner* — George B Bennett
(74) *Attorney, Agent, or Firm* — Robert J. Yarbrough; Lipton, Weinberger & Husick

(57) ABSTRACT

The invention is an apparatus and method for marking a pitcher's circle for a sport such as girl's fast pitch softball. A spike locates the center of the circle and a cord attached to the spike defines the radius of the circle. A scribe attached to a handle and to the cord is configured to mark the dirt. The scribe defines a marking tip and an indicator portion. The marking tip leaves a track in the dirt that is within a track left by the indicator portion when the handle is in the proper vertical position.

17 Claims, 6 Drawing Sheets

(56) References Cited

U.S. PATENT DOCUMENTS

| | | | | |
|---|---|---|---|---|
| 7,191,530 | B1 * | 3/2007 | Thibodeaux | G01B 3/1071 33/27.032 |
| 7,887,443 | B2 | 2/2011 | Bryant | |
| 2005/0155234 | A1 * | 7/2005 | Xieh | B43L 7/10 33/27.03 |
| 2006/0010705 | A1 | 1/2006 | Dettelis | |
| 2006/0207114 | A1 * | 9/2006 | Stoner | B43L 9/04 33/27.03 |

* cited by examiner

PITCHER'S CIRCLE COMPASS

I. BACKGROUND OF THE INVENTION

A. Field of the Invention

The Invention is an apparatus for marking a pitcher's circle on a softball or baseball pitcher's mound. The Invention is also a method of marking a pitcher's circle using the apparatus. The Invention is of particular utility in the sport of girl's fast pitch softball.

B. Statement of the Related Art

In the sport of girl's fast pitch softball, the pitcher's circle is a circle with a radius of eight feet with its center located at the center of the front of the pitcher's plate or rubber.

Under the rules of girl's fast pitch softball, play begins when the pitcher is inside the pitcher's circle and in control of the softball. When the pitcher is inside the pitcher's circle with control of the softball, all base runners must be in contact with their bases. When the pitcher throws the ball, the pitcher is no longer in control of the ball and a base runner can run to the next base. If the base runner is between bases when the pitcher gains control of the softball inside the pitcher's circle, then the base runner must either advance to the next base or retreat to the previous base but cannot dance between bases.

The accuracy and visibility of the pitcher's circle is crucial to the accuracy of game play for girl's fast pitch softball.

Previous efforts have been made to develop apparatus for locating the elements of sporting fields. U.S. Pat. No. 3,039,197 to Abbott, issued Jun. 19, 1962 provided a tape for laying out croquet courts. U.S. Pat. No. 3,668,781 to Teter issued Jun. 13, 1978 taught an apparatus for laying out a baseball diamond, including cords on reels. U.S. Pat. No. 7,887,443 to Bryant, issued Feb. 15, 2011, teaches a compass for drawing a pitcher's circle in the dirt around a pitcher's rubber. The compass of Bryant is attached to the center of the pitcher's rubber. A chain controls the distance from the Bryant scribe to the center of the pitcher's rubber. The scribed line of Bryant can vary in size by the attitude at which the operator holds the scribe. The appearance of the Bryant scribed circle does not provide feedback to the operator or to an umpire checking the pitcher's circle as to whether the operator properly held the scribe.

The prior art does not teach the apparatus of the Invention.

II. BRIEF DESCRIPTION OF THE INVENTION

The Invention is a tool for scribing a visible pitcher's circle in the dirt around a pitcher's rubber for use in sports such as fast pitch girl's softball. The invention includes a spike to define the center of the pitchers circle. In use, the user inserts the spike into the dirt immediately in front of the center of the pitcher's rubber. The spike is the pivot point about which the user will scribe the pitcher's circle.

A non-stretchable cord is configured for rotation about the spike, as by an eyelet penetrated by the spike and attached to the cord. The cord and eyelet combination defines the radius of the pitcher's circle and joins the spike to a scribe. In use, the user will extend the scribe to the length of the cord from the spike.

The scribe is attached to the bottom end of an elongated handle. The elongated handle is of adequate length and girth so that a user can grip the elongated handle with both hands and use both hands to control the handle while scribing the pitcher's circle. A handle of between four and five feet in length has proven suitable in practice. The handle defines a handle longitudinal axis along the length of the handle.

The scribe defines a marking tip. The marking tip is aligned with the handle longitudinal axis. When the user holds the handle in a vertical position with the cord extending for its length from the spike and moves around the spike in a circle with the cord extended for its length and with the marking tip in contact with the dirt, the marking tip scribes a circle in the dirt around the spike.

The scribe defines an indicator portion. The indicator portion also is disposed along the longitudinal axis of the handle. The marking tip extends proud of the indicator portion along the handle longitudinal axis. The indicator portion may define the marking tip. The indicator portion has a width that is greater than the marking tip width. Both the indicator portion and the marking tip contact the dirt when the user is scribing the circle. The indicator leaves a relative wide indicator portion track in the dirt. The indictor portion track defines indicator portion track edges at the boundaries of the indicator portion track. The smaller marking tip leaves a smaller marking tip track in the dirt. The marking tip track is disposed between the indicator track edges when the handle is vertically oriented.

The location of the marking tip track relative to the indicator portion track informs the user (or an umpire) as to whether the user maintained the proper vertical orientation of the handle during the scribing process. If the smaller marking tip track is centered within the indicator track edges, then the user held the handle in the vertical position and the circle is accurate. If the mark left by the indicator portion is not centered, then the user did not hold the handle in the vertical position and the circle is not accurate.

The indicator portion may be an ogive, which is the geometrical term for the shape of the end of a football or a bullet. The tip of the ogive may define the marking tip. Alternatively, the indicator portion may be hemispherical or another rounded shape and the marking tip may protrude from the indicator portion. As other alternatives, the indicator portion may be a wide cone and the apex of the cone may define the marking tip, or the indicator portion may define a right cylinder and the marking tip may protrude from the center of the right cylinder. All other combinations of shapes for the marking tip and the indicator portion that allow both to mark the dirt simultaneously and that provide that the mark of the marking tip is within the mark of the indicator portion when the handle is vertically oriented are contemplated by the invention.

The handle may provide for storage of the spike when the apparatus is not in use. For example, the end of the handle may define a clamp, for example a clamp composed of a resilient polymer, to receive and selectably retain the spike. The user may store the cord by wrapping the cord about the handle.

III. BRIEF DESCRIPTION OF THE DRAWINGS

IV. DESCRIPTION OF AN EMBODIMENT

Figure 1:
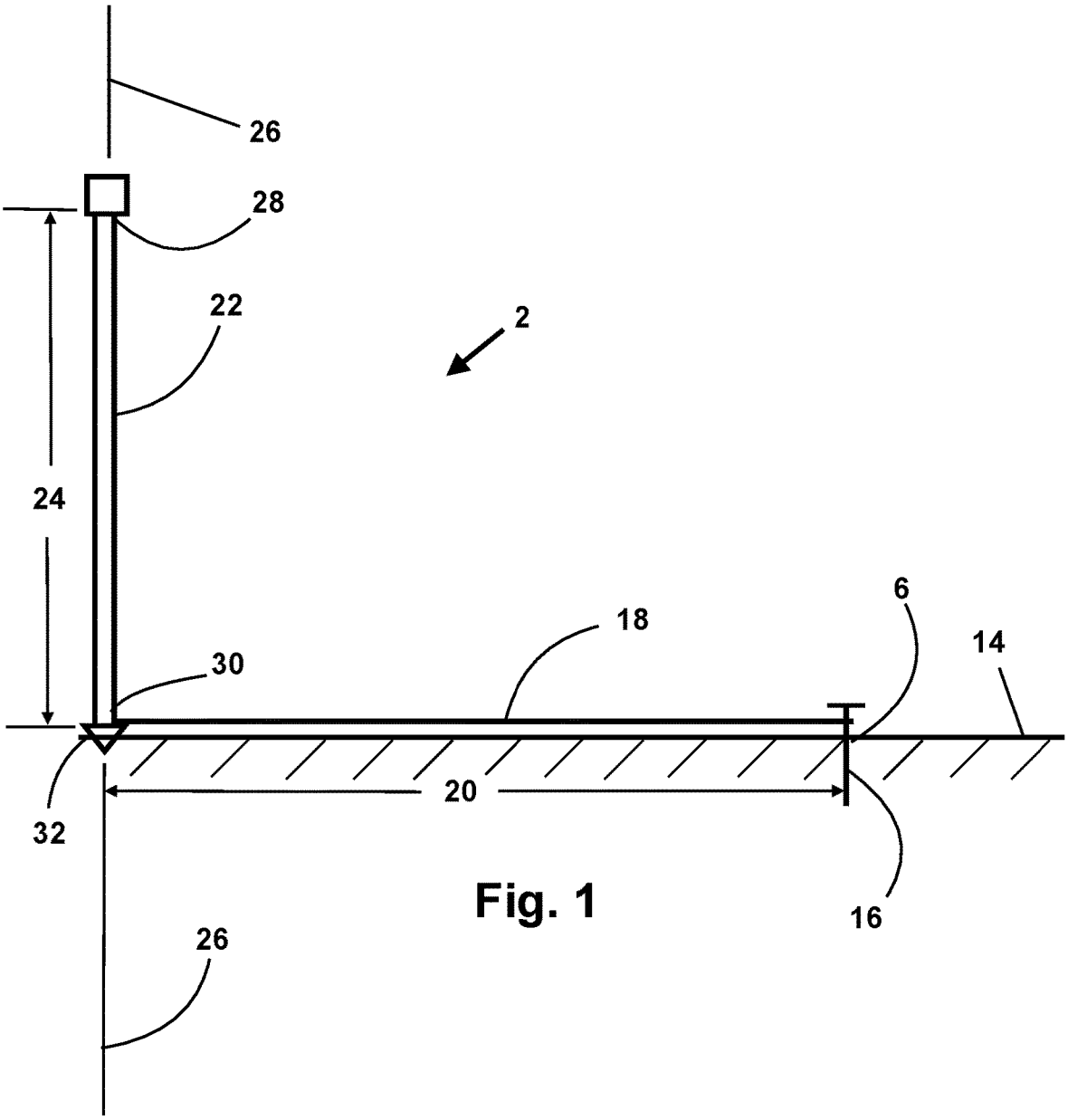
FIG. 1 is a side view of the apparatus of the Invention.
Figure 2:
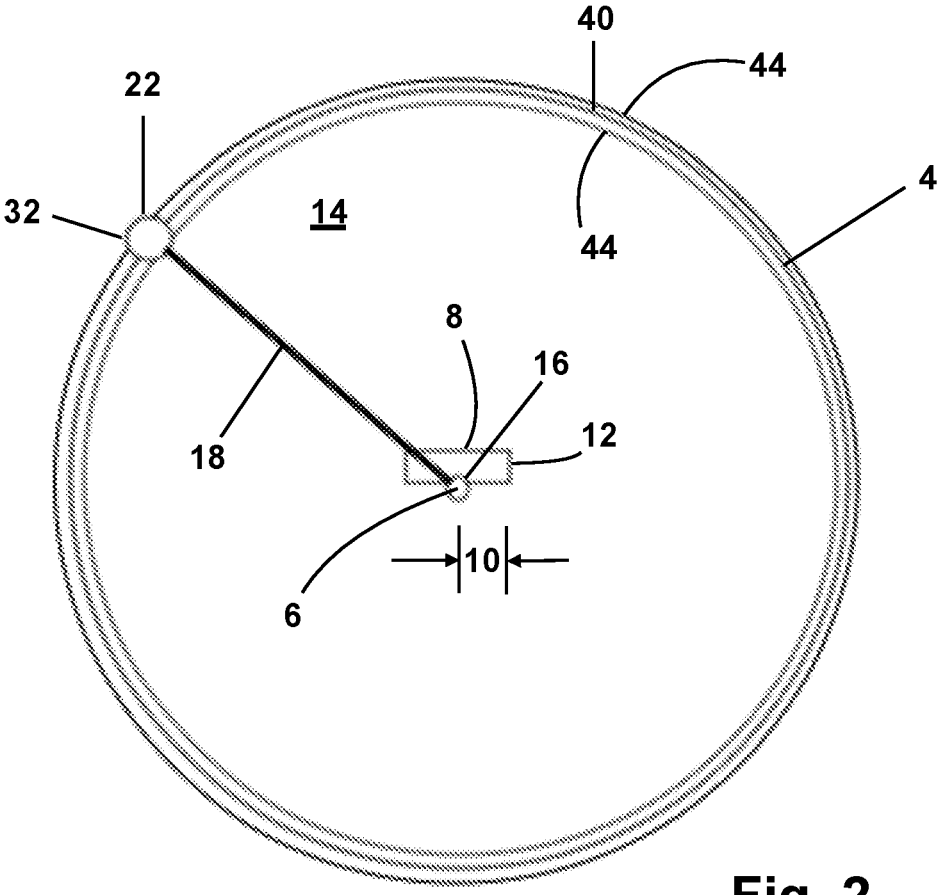
FIG. 2 is a top view of the apparatus being used to scribe a pitcher's circle.

From FIGS. 1 and 2, the apparatus of the Invention is a pitcher's circle marking tool 2 for marking a pitcher's circle 4 in dirt 14. FIG. 1 is a side view of the marking tool 2 deployed and ready to mark a pitcher's circle 4. FIG. 2, which is not to scale, is a top view of the marking tool 2 in use to mark the pitcher's circle 4. The pitcher's circle 4 for the game of fast-pitch softball has a radius of eight feet. From FIG. 2, the center 6 of the pitcher's circle 4 is located along the front edge of the pitcher's rubber 8 a distance 10 of seven inches from the end 12 of the pitcher's rubber 8.

From FIGS. 1 and 2, the marking tool 2 of the invention includes a spike 16 that the human user inserts into the dirt 14 at the center 6 of the pitcher's circle 4. A cord 18 is attached to the spike 16, as by a grommet or eyelet, so that the cord 18 may rotate about the spike 16. The cord 18 is composed of a material that does not stretch and defines the radius 20 of the pitcher's circle 4. The cord 18 also is attached to a handle 22. The handle 22 has a length 24. The length and girth of the handle 22 are selected so that a human user can grip the handle 22 with two hands while standing in an upright position and can thus control the orientation of the handle 22 as the user moves around the center 6 at the radius 20 defined by the cord 18 and marks the pitcher's circle 4. A handle length 24 of four to five feet has proven suitable in practice, but longer and shorter handles 22 are contemplated by the Invention.

The handle 22 has a handle longitudinal axis 26 along the length 24 of the handle 22. To draw an accurate pitcher's circle 4, the user must hold the handle 22 so that the longitudinal axis 26 is vertical in the radial direction; namely, so that the longitudinal axis 26 is normal to the radius 20. If the top end 28 of the handle 22 is angled toward the center 6, the pitcher's circle 4 will be too large and if the top end 28 of the handle 22 is angled away from the center 6, the pitcher's circle 4 will be too small. If the user allows the top end 28 to move toward or away from the center 6 while marking the pitcher's circle 4, the radius 20 of the pitcher's circle 4 will vary around its circumference.

A scribe 32 is located at the bottom end 30 of the handle 22 and is in contact with the dirt 14 when the user is marking the pitcher's circle 4. The construction of the scribe 32 informs the user as to the vertical orientation of the handle longitudinal axis 26 in the radial direction and allows the user to manipulate the handle 22 to maintain a vertical orientation of the handle longitudinal axis 26 in the radial direction.

FIGS. 3, 4, 5 and 9 illustrate alternative embodiments of the scribe 32. In each of the embodiments of FIGS. 3, 4, 5 and 9, the scribe 32 has an indicator portion 34 and a marking tip 36. The indicator portion 34 has an indicator portion width 38 (shown by FIG. 3) that is larger than the width of the marking tip 36. Both the indicator portion 34 and the marking tip 36 are aligned with the handle longitudinal axis 26, with the marking tip 36 extending further than the indicator portion 34 along the handle longitudinal axis 26 from the handle 22.

Figure 3:
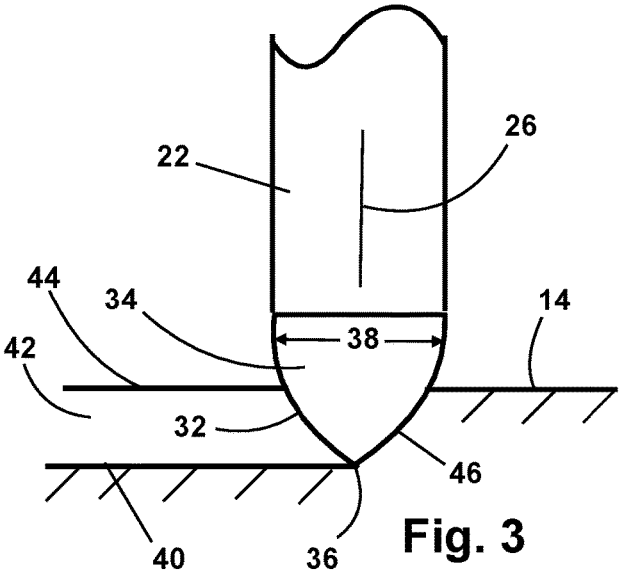
FIG. 3 is a detail side view of a first embodiment scribe in the shape of an ogive and creating an indicator portion track and a marking tip track.

In each of the scribe 32 embodiments of FIGS. 3, 4, 5 and 9, the indicator portion 34 has a shape. In FIG. 3, the shape of the indicator portion 34 is an ogive 46, which may be the geometrical shape of one end of a football or of a bullet. The ogive 46 has an ogive width, which defines the indicator portion width 38. The ogive 46 has an ogive point, which defines the marking tip 36.

Figure 4:
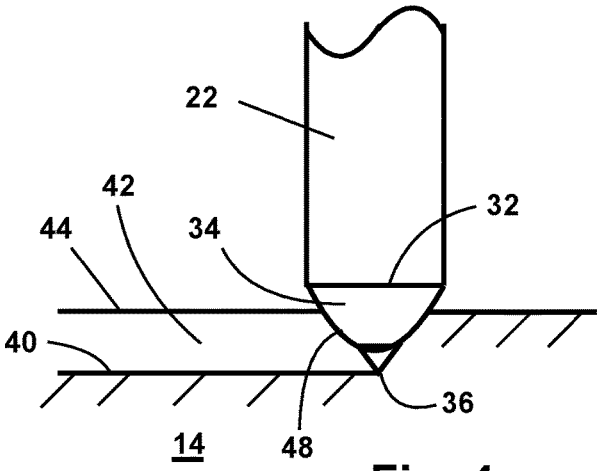
FIG. 4 is a detail side view of a second embodiment scribe in the shape of a curve creating an indicator portion track and a marking tip track.

In FIG. 4, the shape of the indicator portion 34 is a curve 48. The curve 48 has a curve diameter, which defines the indicator portion width 38. The curve 48 may be any suitable curve 48, such as an ovoid, a hemisphere, or any other curve 48. Where the curve 48 is an ovoid, the ovoid has an ovoid diameter that defines the indicator portion width 38. Where the curve is a hemisphere, the hemisphere has a hemisphere diameter that defines the indicator portion width 38. The curve embodiment is not limited to ovoids and hemispheres and may be any suitable curved shape.

Figure 5:
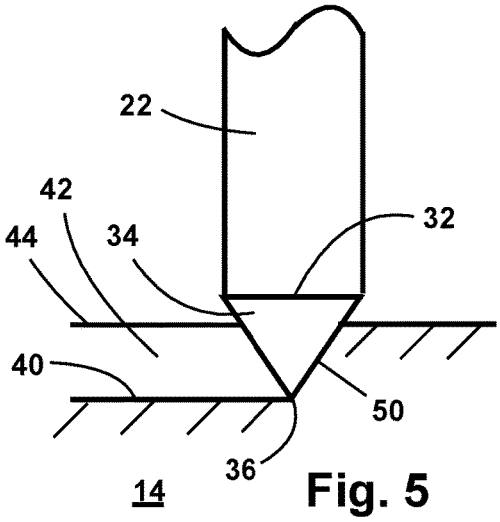
FIG. 5 is a detail side view of a third embodiment scribe in the shape of a cone and creating an indicator track and a marking tip track.

From FIG. 5, a cone 50 may define the indicator portion 34 and the apex of the cone 50 may define the marking tip 36. The diameter of the base of the cone 50 defines the indicator portion width 38.

Figure 6:
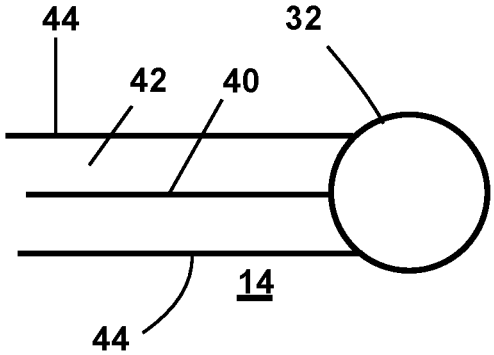
FIG. 6 is a detail top view of the scribe in a vertical position and marking dirt.
Figure 7:
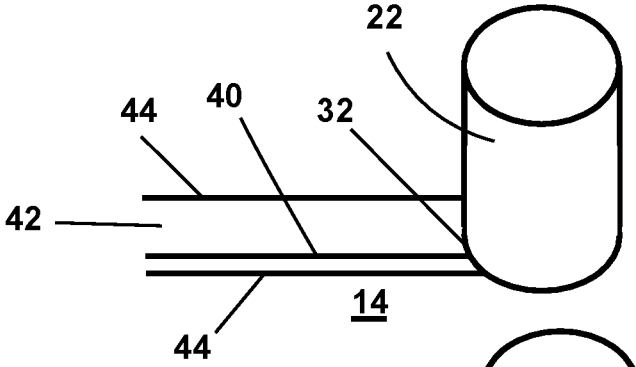
FIG. 7 is a detail top view of the scribe in a position that is not vertical and that has a tilt in a radial direction.
Figure 8:
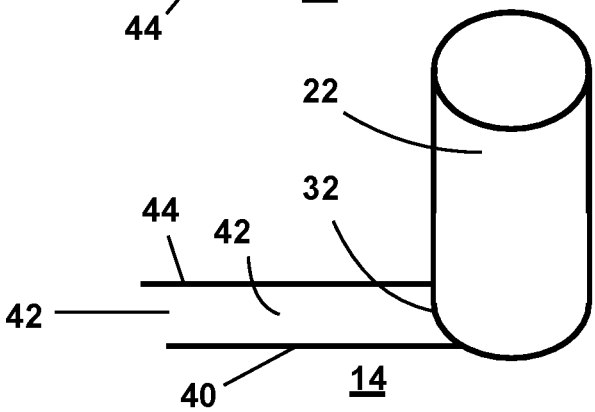
FIG. 8 is a detail top view of the scribe in a position that has a greater tilt in the radial direction than FIG. 7.

FIGS. 6, 7 and 8, in combination with FIGS. 2 through 5, illustrate the operation of the scribe 32 to inform the user of the orientation of the handle 22. To use the pitcher's circle marking tool 2, the user will fix the spike 16 into the dirt at the center 6 and will extend the cord 18 from the spike 16. The user then will move the handle 22 with the handle longitudinal axis 26 in a vertical position with respect to the radial direction with the scribe 32 in contact with the dirt 14 and with the distance from the handle 22 to the center 6 defined by the cord 18 to mark the pitcher's circle 4. From the detail side views of FIGS. 3, 4 and 5, the marking tip 36 and the indicator portion 34 are in continuous contact with the dirt 14 as the user moves about the spike 16.

As the user moves, the narrow marking tip 36 scribes a marking tip track 40 in the dirt 14, as shown by FIGS. 3, 4 and 5. The indicator portion 34 also scribes an indicator portion track 42 in the dirt 14. Because the indicator portion 34 is wider than the marking tip 36, the indicator portion track 42 is wider than the marking tip track 40. The indicator portion track 42 is bounded by indicator portion track edges 44.

FIGS. 6, 7 and 8 are top views of the handle 22 and scribe 32 as the scribe 32 marks the dirt 14. As shown by FIG. 6, when user is holding the handle longitudinal axis 26 in a vertical orientation in the radial direction, the marking tip track 40 is located between and equidistant from the two indicator portion track edge 44. When a user achieves a marking tip track 40 and indicator portion track edges 44 as shown by FIG. 6, the longitudinal axis 26 is vertically oriented in the radial direction and the resulting pitching circle 4 is accurate.

In FIG. 7, the user is marking the pitching circle 4, but is not holding the handle 22 so that the longitudinal axis 26 is vertical in the radial direction. In FIG. 7, the handle 22 is leaning either toward or away from the center 6. The resulting marking tip track 40 is not equidistant from the two indicator track edges 44 and so the resulting pitcher's circle 4 is not accurate. The user can correct the orientation of the handle longitudinal axis 26 by manipulating the handle 22 so that the marking tip track 40 is again equidistant between the two indicator portion track edges 44.

FIG. 8 is similar to FIG. 7, except that the handle longitudinal axis 26 is even farther from the vertical. In FIG. 7, the marking tip tack 40 has crossed one of the indicator portion track edges 44. The resulting pitcher's circle 4 will not be accurate. As for FIG. 7, the user can correct the pitcher's circle 6 by re-orienting the handle 22 so that the marking trip track 40 is equidistant between the indicator portion track edges 44.

Figure 9:
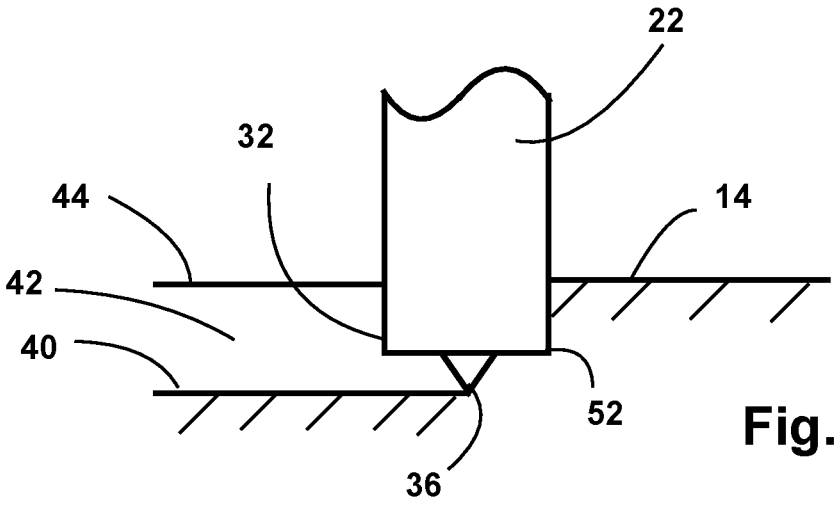
FIG. 9 is a detail side view of a fourth embodiment scribe in the shape of a cylinder creating an indicator track and a marking tip track.
Figure 10:
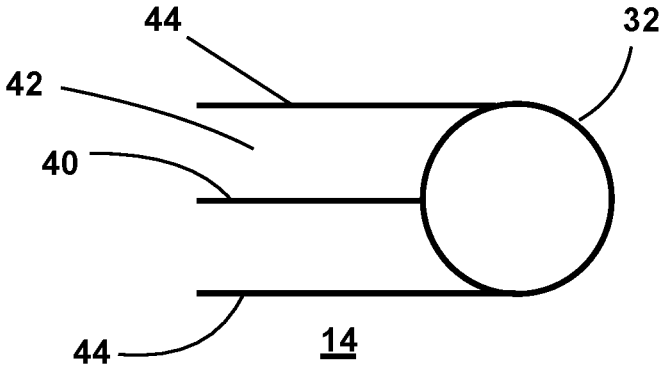
FIG. 10 is a detail top view of the fourth embodiment scribe in the vertical position and creating an indicator track and a marking tip track.

FIGS. 9 and 10 show another embodiment of the scribe 32. In the embodiment of FIGS. 9 and 10, the scribe 32 has the shape of a cylinder 52, which is illustrated as a right cylinder. From FIG. 9, the cylinder 52 has a diameter, which defines the indicator portion width 38. A marking tip 36 depends from the cylinder 52 and extends further from the handle 22 than the cylinder 52. Both the cylinder 52 and the marking tip 36 are aligned with the handle longitudinal axis 26.

FIG. 10 is a detail top view of the indicator portion 32 in the shape of the cylinder 52 with the handle 22 and handle longitudinal axis 26 oriented vertically. The width of the cylinder 52 defines the indicator portion width 38 and the distance between the indicator portion track edges 44 in the dirt 14. For the vertically oriented handle longitudinal axis 26, the marking tip track 40 is disposed equidistant from the two indicator portion track edges 44. If the marking tip track 40 is not disposed equidistant between the two indicator portion track edges 44, then the handle longitudinal axis 26 is not vertically oriented and the pitcher's circle 4 will not be accurate. The marking tip track 40 and its location in the dirt 14 relative to the indicator portion track edges 44 provide feedback to the user as to the accuracy of the pitcher's circle 4 that the user is preparing.

Figure 11:
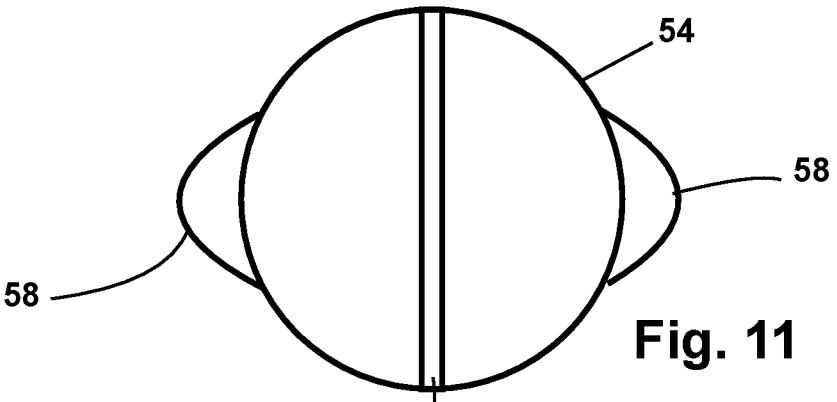
FIG. 11 is a top view of a clamp for a spike.
Figure 12:
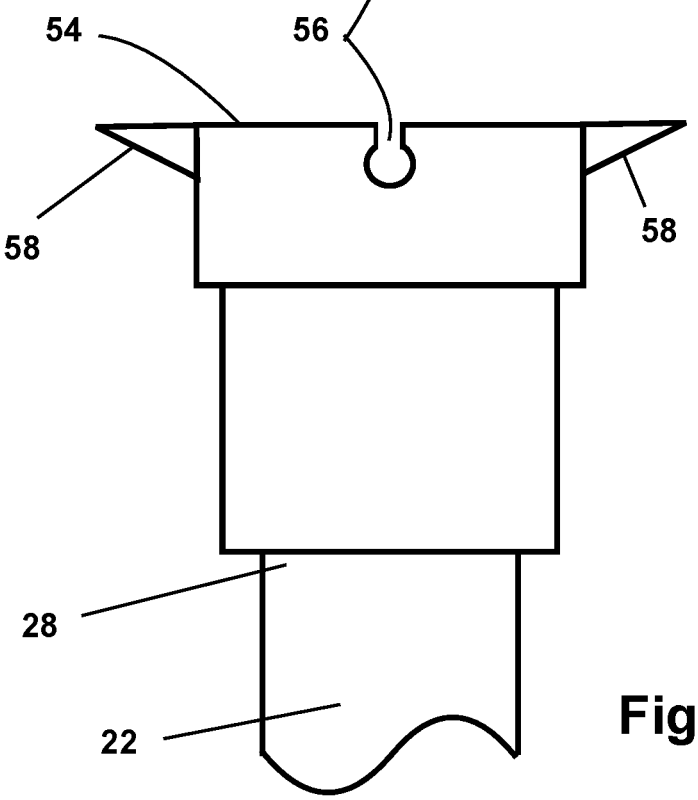
FIG. 12 is a detail side view of the clamp for the spike.

FIGS. 11 and 12 illustrate a resilient clamp 54 to releasably secure the spike 16 to the top end 28 of the handle 22 for storage. The resilient clamp 54 includes a spike-receiving opening 56 and two resilient levers 58. To use the resilient clamp 54, a user will press the two levers 58 toward the bottom end 30 of the handle 22, resiliently opening the spike-receiving opening 56. The user may then replace or remove the spike 16 from the opening 56. To secure the spike 16 in the opening 56, the user will release the two levers 58 with the spike 16 disposed in the opening 56. The resilient clamp 54 then will close around the spike 16, securing the spike 16 to the handle 22.

For the convenience of the user, the handle 22 may include a mark to indicate the distance of seven inches, which is half of the length of the regulation pitcher's rubber 8 for girl's fast pitch softball. The user may use the mark to locate the center 6 by measuring seven inches from the end of the pitcher's rubber 8 along the front edge of the pitcher's rubber 8.

LIST OF ELEMENTS

The following are the numbered elements of the drawings and specification.

a pitcher's circle marking tool 2
a pitcher's circle 4
a center 6
a pitcher's rubber 8
a distance 10
an end 12
a dirt 14
a spike 16
a cord 18
a radius 20
a handle 22
a length 24
a handle longitudinal axis 26
a top end of the handle 28
a bottom end of the handle 30
a scribe 32
an indicator portion 34
marking tip 36
an indicator portion width 38
marking tip track 40
indicator portion track 42
indicator portion track edges 44.
an ogive 46
a curve 48
a cone 50
a cylinder 52
a clamp 54

I claim:

1. An apparatus for marking a pitcher's circle in a dirt by a human user, the apparatus comprising:

a. a spike configured to be retained by the dirt to define a center of the pitcher's circle;

b. a cord configured for rotatable attachment to the spike, the cord defining a radius of the pitcher's circle;

c. a handle having a length and defining a handle longitudinal axis along the length of the handle, the handle being attached to the cord;

d. a scribe disposed at a bottom end of the handle and aligned with the handle longitudinal axis, the scribe defining an indicator portion, the indicator portion having an indicator portion width, the indicator portion being configured so that when the indicator portion is in continuous contact with the dirt and the handle is moved with the handle in a vertical orientation, the indicator portion leaves an indicator portion track in the dirt, the indicator portion track defining indicator portion track edges;

e. a marking tip defined by the scribe and aligned with the handle longitudinal axis, the marking tip extending beyond the indicator portion from the handle, the marking tip having a marking tip width, the marking tip width being less than the indicator portion width, the marking tip being configured so that when the handle is vertically oriented with the indicator portion is in continuous contact with the dirt and the handle is moved, the marking tip leaves a marking tip track in the dirt, the marking tip track being disposed between the indicator portion track edges when the handle is vertically oriented.

2. The apparatus of claim 1 wherein the scribe has a shape, the shape of the scribe being an ogive, the ogive having an ogive diameter, the ogive diameter defining the indicator portion width, the ogive having an ogive tip, the ogive tip defining the marking tip.

3. The apparatus of claim 1 wherein the scribe has a shape, the shape of the scribe being a hemisphere, the hemisphere having a hemisphere diameter, the hemisphere diameter defining the indicator portion diameter, the marking tip extending from the hemisphere.

4. The apparatus of claim 1 wherein the scribe has a shape, the shape being an ovoid, the ovoid having an ovoid diameter the ovoid diameter defining the indicator portion diameter, the marking tip extending from the ovoid.

5. The apparatus of claim 1 wherein the scribe has a shape, the shape being a curve, the curve having a curve diameter, the curve diameter defining the indicator portion diameter, the marking tip extending from the curve.

6. The apparatus of claim 1 wherein the scribe has a shape, the shape being a cone, the cone having a cone diameter, the cone diameter defining the indicator portion diameter, the cone having an apex, the apex defining the marking tip.

7. The apparatus of claim 1 wherein the scribe has a shape, the shape being a cylinder, the cylinder having a cylinder diameter, the cylinder diameter defining the indicator portion diameter, the marking tip extending beyond the cylinder.

8. The apparatus of claim 1 further comprising: a clamp configured to selectably retain the spike, the clamp being disposed at a top end of the handle.

9. The apparatus of claim 1 further comprising: a mark, the mark being disposed on the handle, the mark indicated a distance from an and of a pitcher's rubber to the center of the pitcher's circle.

10. A method of marking a pitcher's circle in dirt, the method comprising:

a. fixing a spike to the dirt;

b. deploying a cord attached to the spike and configured for rotation about the spike, the cord defining a radius of the pitcher's circle;

c. providing a handle attached to the cord, the handle defining a longitudinal axis along a length of the handle;

d. providing a scribe disposed at a bottom end of the handle and aligned with the handle longitudinal axis, the scribe defining an indicator portion, the indicator portion having an indicator portion width, the indicator portion being configured so that when the indicator portion is in continuous contact with the dirt and the handle is moved with the handle in a vertical orientation, the indicator portion leaves an indicator portion track in the dirt, the indicator portion track defining indicator portion track edges;

e. providing a marking tip defined by the scribe and aligned with the handle longitudinal axis, the marking tip extending beyond the indicator portion from the handle, the marking tip having a marking tip width, the marking tip width being less than the indicator portion width, the marking tip being configured so that when the handle is vertically oriented with the indicator portion is in continuous contact with the dirt and the handle is moved, the marking tip leaves a marking tip track in the dirt, the marking tip track being disposed between the indicator portion track edges when the handle is vertically oriented;

f. orienting the handle vertically at the end of the cord so that the marking tip and the indicator portion are in contact with the dirt;

g. moving the handle in a circle about the spike at the end of the cord while observing the marking tip track and the indicator portion track and adjusting the position of the handle to maintain the marking tip track between the indicator portion track edges.

11. The method of claim 10 wherein the scribe has a shape, the shape of the scribe being an ogive, the ogive having an ogive diameter, the ogive diameter defining the indicator portion width, the ogive having an ogive tip, the ogive tip defining the marking tip.

12. The method of claim 10 wherein the scribe has a shape, the shape of the scribe being a hemisphere, the hemisphere having a hemisphere diameter, the hemisphere diameter defining the indicator portion diameter, the marking tip extending from the hemisphere.

13. The method of claim 10 wherein the scribe has a shape, the shape being an ovoid, the ovoid having an ovoid diameter the ovoid diameter defining the indicator portion diameter, the marking tip extending from the ovoid.

14. The method of claim 10 wherein the scribe has a shape, the shape being a curve, the curve having a curve diameter, the curve diameter defining the indicator portion diameter, the marking tip extending from the curve.

15. The method of claim 10 wherein the scribe has a shape, the shape being a cone, the cone having a cone diameter, the cone diameter defining the indicator portion diameter, the cone having an apex, the apex defining the marking tip.

16. The method of claim 10 wherein the scribe has a shape, the shape being a cylinder, the cylinder having a cylinder diameter, the cylinder diameter defining the indicator portion diameter, the marking tip extending beyond the cylinder.

17. The method of claim 10, the method further comprising: prior to the step of fixing the spike to the dirt, releasing the spike from a clamp selectably retaining the spike to the handle.

* * * * *